US009658574B2

(12) United States Patent
Tsuritani et al.

(10) Patent No.: US 9,658,574 B2
(45) Date of Patent: May 23, 2017

(54) POWDER CONTAINER, DEVELOPING DEVICE, PROCESS UNIT, AND IMAGE FORMING APPARATUS

(71) Applicants: Shoh Tsuritani, Osaka (JP); Tomohiro Kubota, Osaka (JP); Yoshiyuki Shimizu, Osaka (JP); Masato Tsuji, Osaka (JP); Akinori Harada, Osaka (JP); Kyoko Abe, Osaka (JP)

(72) Inventors: Shoh Tsuritani, Osaka (JP); Tomohiro Kubota, Osaka (JP); Yoshiyuki Shimizu, Osaka (JP); Masato Tsuji, Osaka (JP); Akinori Harada, Osaka (JP); Kyoko Abe, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/086,776

(22) Filed: Mar. 31, 2016

(65) Prior Publication Data

US 2016/0299455 A1 Oct. 13, 2016

(30) Foreign Application Priority Data

Apr. 7, 2015 (JP) ..... 2015-078445
Aug. 25, 2015 (JP) ..... 2015-165977

(51) Int. Cl.
*G03G 15/08* (2006.01)

(52) U.S. Cl.
CPC ..... *G03G 15/0891* (2013.01); *G03G 15/0846* (2013.01); *G03G 15/0889* (2013.01); *G03G 15/0893* (2013.01); *G03G 2215/0132* (2013.01); *G03G 2215/0838* (2013.01)

(58) Field of Classification Search
CPC ..... G03G 15/0832; G03G 15/0834; G03G 15/0846; G03G 15/0865; G03G 15/0875; G03G 15/0887–15/0893
See application file for complete search history.

(56) References Cited

U.S. PATENT DOCUMENTS

2007/0223945 A1* 9/2007 Chiba ..... G03G 15/0855 399/27
2008/0055381 A1* 3/2008 Doi ..... B41J 2/0057 347/103
2008/0187358 A1 8/2008 Kubota et al.
2008/0205930 A1 8/2008 Kawakami et al.
(Continued)

FOREIGN PATENT DOCUMENTS

JP 2012189787 A * 10/2012
JP 2013-125148 6/2013
(Continued)

OTHER PUBLICATIONS

Machine translation of JP 2012-189787. Oct. 4, 2012.*

*Primary Examiner* — David Gray
*Assistant Examiner* — Carla Therrien
(74) *Attorney, Agent, or Firm* — Oblon, McClelland, Maier & Neustadt, L.L.P.

(57) ABSTRACT

A powder container is provided. The powder container includes a powder storage and a conveyer. The powder storage stores a powder to be used for image formation and has a vent hole to pass air between an inside and an outside of the powder storage. The conveyer conveys the powder inside the powder storage. The vent hole is on an upper surface of the powder storage facing the conveyer.

20 Claims, 12 Drawing Sheets

(56) References Cited

U.S. PATENT DOCUMENTS

| | | | | |
|---|---|---|---|---|
| 2009/0022531 | A1 | 1/2009 | Kubota et al. | |
| 2009/0162101 | A1 | 6/2009 | Yoshida et al. | |
| 2012/0033996 | A1 | 2/2012 | Takehara et al. | |
| 2012/0114373 | A1 | 5/2012 | Hamada et al. | |
| 2012/0189352 | A1* | 7/2012 | Yamauchi ..... | G03G 15/0893 399/258 |
| 2013/0028638 | A1 | 1/2013 | Tsuritani et al. | |
| 2013/0078003 | A1* | 3/2013 | Stelter ..... | G03G 15/0893 399/254 |
| 2013/0259532 | A1 | 10/2013 | Kubota et al. | |
| 2013/0266347 | A1 | 10/2013 | Kubota et al. | |
| 2014/0050502 | A1 | 2/2014 | Tsuritani et al. | |
| 2014/0050507 | A1 | 2/2014 | Hamada et al. | |
| 2014/0169827 | A1* | 6/2014 | Hattori ..... | G03G 15/0882 399/106 |
| 2014/0205311 | A1* | 7/2014 | Kashimoto ..... | G03G 15/0889 399/98 |
| 2014/0356004 | A1 | 12/2014 | Tsuritani et al. | |
| 2014/0376951 | A1* | 12/2014 | Ogawa ..... | G03G 15/0898 399/98 |

FOREIGN PATENT DOCUMENTS

| | | |
|---|---|---|
| JP | 2013-231802 | 11/2013 |
| JP | 2014-134671 | 7/2014 |

* cited by examiner

POWDER CONTAINER, DEVELOPING DEVICE, PROCESS UNIT, AND IMAGE FORMING APPARATUS

CROSS-REFERENCE TO RELATED APPLICATIONS

This patent application is based on and claims priority pursuant to 35 U.S.C. §119(a) to Japanese Patent Application Nos. 2015-078445 and 2015-165977, filed on Apr. 7, 2015 and Aug. 25, 2015, respectively, in the Japan Patent Office, the entire disclosure of each of which is hereby incorporated by reference herein.

BACKGROUND

Technical Field

The present disclosure relates to a powder container, a developing device, a process unit, and an image forming apparatus.

Description of the Related Art

A developing device to be mounted on an electrophotographic image forming apparatus, such as copier and printer, is generally provided with a conveyer, such as a screw, to convey developer inside the developing device.

As an example, a developing device is known, which conveys developer within a circulation path that is divided into an upper compartment and a lower compartment by a partition. More specifically, the upper compartment, serving as a development chamber, and the lower compartment, serving as an agitation chamber, are in communication with each other through openings provided on respective ends of the partition. One of the openings serves as a drawing part where developer is drawn up and the other opening serves as a dropping part where developer is dropped down. Inside each of the development chamber and the agitation chamber, a screw is provided. As the screws rotate, developer in the development chamber is conveyed to the dropping part and dropped down to the agitation chamber, and developer in the agitation chamber is conveyed to the drawing part and drawn up to the development chamber.

SUMMARY

In accordance with some embodiments of the present invention, a powder container is provided. The powder container includes a powder storage and a conveyer. The powder storage stores a powder to be used for image formation and has a vent hole to pass air between an inside and an outside of the powder storage. The conveyer conveys the powder inside the powder storage. The vent hole is on an upper surface of the powder storage facing the conveyer.

In accordance with some embodiments of the present invention, a developing device is provided. The developing device includes a developer container to contain a developer, a developer bearer to bear the developer, and a developer supplier to supply the developer from the developer container to the developer bearer. The developer container includes the above powder container, and the developer includes the above powder to be used for image formation.

In accordance with some embodiments of the present invention, a process unit detachably mountable on an image forming apparatus is provided. The process unit includes a latent image bearer to bear a latent image and the above developing device to develop the latent image on the latent image bearer with the developer.

In accordance with some embodiments of the present invention, an image forming apparatus is provided. The image forming apparatus includes a latent image bearer to bear a latent image and a developing device to develop the latent image on the latent image bearer with a developer. The developing device includes a developer container to contain a developer, a developer bearer to bear the developer, and a developer supplier to supply the developer from the developer container to the developer bearer. The developer container includes the above powder container, and the developer includes the above powder to be used for image formation.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
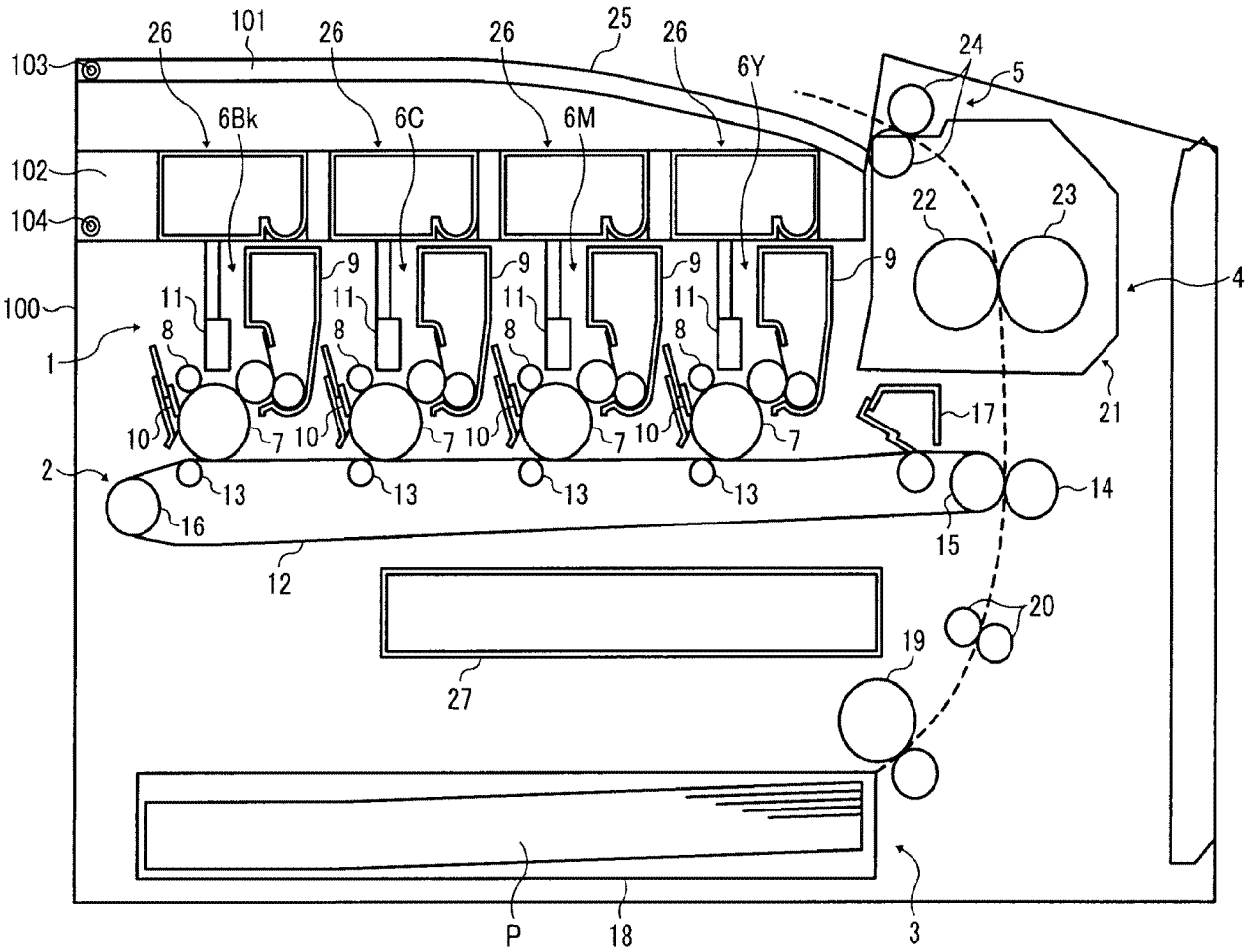
FIG. 1 is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

In the known developing device having a circulation path divided into an upper compartment and a lower compartment, at portions where developer is moved in the direction intersecting with the axial direction of the screws, i.e., the dropping part and the drawing part, developer conveyance speed becomes slow, causing developer to easily accumulate in these portions. In a case in which the screw has a planar agitation blade in part, it is difficult in that part to generate a developer conveyance force to convey developer in the axial direction. Therefore, it is likely that developer becomes stagnant or accumulates in that part.

Accumulated developer prevents the air within the circulation path from being moved along with developer when the developer is conveyed within the circulation path, thus increasing the inner pressure of the circulation path. As the inner pressure increases, developer is pressurized to cause aggregation. Aggregated developer is hardly smoothly conveyed within the circulation path. In addition, aggregated developer possibly clogs the circulation path.

Defective conveyance of developer is induced by fluctuation of the inner pressure not only in developing device, but also in powder containers such as toner cartridge for storing toner. Further, recently, developing devices and powder containers have been improved in airtightness to more effectively prevent air leakage, downsized in accordance with downsizing of image forming apparatus, and developer conveyance path has become more complicated in its structure. Because of these factors, defective conveyance or clogging of developer is more likely to occur.

In accordance with some embodiments of the present invention, a powder container is provided which allows air to flow in or out through a vent hole when a powder is being conveyed therein. This powder container can suppress a fluctuation of the inner pressure and prevent defective conveyance of the powder.

FIG. 1 is a schematic view of an image forming apparatus according to an embodiment of the present invention. This image forming apparatus is a color printer (hereinafter simply "printer"). The image forming apparatus is not limited to the color printer and can be a monochrome printer, a copier, a facsimile machine, or a multifunction peripheral combining at least two functions of printing, copying, facsimile transmission, and scanning.

Referring to FIG. 1, the printer includes an image forming unit 1, a transfer unit 2, a recording medium supply unit 3, a fixing unit 4, and a recording medium ejection unit 5.

The image forming unit 1 includes four process units 6Y, 6M, 6C, and 6Bk serving as image forming units. The process units 6Y, 6M, 6C, and 6Bk have the same configuration except for containing different color toners, i.e., yellow (Y), magenta (M), cyan (C), and black (Bk) toners, respectively, corresponding to decomposed color components of full-color images.

Each of the process units 6Y, 6M, 6C, and 6Bk includes a photoconductor 7 serving as a latent image bearer, a charging roller 8 serving as a charger to charge the surface of the photoconductor 7, a developing device 9 to develop the latent image on the photoconductor 7, and a photoconductor cleaner 10 to clean the surface of the photoconductor 7. Additionally, irradiators 11 are disposed facing the respective photoconductors 7. The irradiators 11 serve as latent image forming devices to form latent images on the surfaces of the photoconductors 7. In the present embodiment, the irradiators 11 contain a light emitting diode (LED) unit. Alternatively, the irradiators 11 may employ a laser beam scanner containing a laser diode.

The transfer unit 2 includes an intermediate transfer belt 12, multiple primary transfer rollers 13, a secondary transfer roller 14, and a belt cleaner 17. The intermediate transfer belt 12 is in the form of an endless belt, and a toner image (hereinafter simply "image") is transferred from the photoconductor 7 thereonto. Each primary transfer roller 13 primarily transfers the image from the photoconductor 7 onto the intermediate transfer belt 12. The secondary transfer roller 14 secondarily transfers the image from the intermediate transfer belt 12 onto a recording medium. The belt cleaner 17 removes residual toner particles remaining on the outer peripheral surface of the intermediate transfer belt 12.

The intermediate transfer belt 12 is stretched taut with a driving roller 15 and a driven roller 16. The intermediate transfer belt 12 revolves as the driving roller 15 rotates. Each primary transfer roller 13 contacts the respective one of the photoconductors 7 with the intermediate transfer belt 12 therebetween. At each portion where the primary transfer roller 13 contacts the photoconductor 7 with the intermediate transfer belt 12 therebetween, a primary transfer nip is formed. At the primary transfer nip, the image is transferred from the photoconductor 7 onto the intermediate transfer belt 12. The secondary transfer roller 14 contacts the driving roller 15 with the intermediate transfer belt 12 therebetween. At a portion where the secondary transfer roller 14 contacts the driving roller 15 with the intermediate transfer belt 12 therebetween, a secondary transfer nip is formed. In the secondary transfer nip, the image is transferred from the intermediate transfer belt 12 onto a recording medium.

The recording medium supply unit 3 includes a sheet tray 18, a feed roller 19, and a timing roller pair 20. The sheet tray 18 stores a plurality of sheets P of paper serving as recording media. The feed roller 19 feeds the sheets P, one by one, from the sheet tray 18. The timing roller pair 20 feeds the sheet P fed by the feed roller 19 to the secondary transfer nip at a predetermined timing. In addition to sheets of paper, the recording media may be sheets or films of overhead projector (OHP) transparency. Examples of the paper include plain paper, heavy paper, postcard, envelope, thin paper, coated paper (e.g., art paper), and tracing paper.

The fixing unit 4 includes a fixing device 21 to fix the image on the sheet P. The fixing device 21 includes a fixing roller 22 and a pressure roller 23. The fixing roller 22 is heated by a heat source (e.g., heater). The pressure roller 23 contacts the fixing roller 22 at a predetermined pressure to form a fixing nip therebetween.

The recording medium ejection unit 5 includes an ejection roller pair 24 and an ejection tray 25. The ejection roller pair 24 ejects the sheet P fed from the fixing device 21 from the printer. The sheet P ejected by the ejection roller pair 24 is stacked on the ejection tray 25.

The printer further includes multiple toner cartridges 26 each serving as a powder container for storing toner (developer) used for image formation. Each toner cartridge 26 stores toner having the same color as that contained in the corresponding developing device 9. When the amount of toner stored in the developing device 9 falls below a predetermined amount, toner is supplied from the toner cartridge 26 thereto. The printer further includes a waste-toner container 27 serving as another powder container independent from the toner cartridges 26. The waste-toner container 27 stores waste toner collected by the belt cleaner 17 and the photoconductor cleaners 10.

Example operation of the printer is described below with reference to FIG. 1.

When image formation is started, the photoconductor 7 is driven to rotate, and the charging roller 8 uniformly charges the surface of the photoconductor 7 to a predetermined polarity. The irradiator 11 emits laser light to the charged surface of the photoconductor 7 based on image information transmitted from a reading device or a computer to form a latent image (electrostatic latent image) thereon. More specifically, the latent images are formed on the surfaces of the photoconductors 7 based on respective single color information, namely, yellow, cyan, magenta, and black color information decomposed from full-color image information. The latent image formed on the photoconductor 7 is developed into a toner image (visible image) with toner supplied from the developing device 9.

The toner images are sequentially transferred from the photoconductors 7 onto the intermediate transfer belt 12 that is revolving, and superimposed on one another on the intermediate transfer belt 12. More specifically, when the toner image on the photoconductor 7 reaches the primary transfer nip, the toner image is transferred from the photoconductor 7 onto the intermediate transfer belt 12*a* by a transfer electric field formed by applying a predetermined voltage to the primary transfer roller 13. Thus, a full-color composite toner image is formed on the surface of the intermediate transfer belt 12. Residual toner particles remaining on the photoconductor 7 without being transferred onto the intermediate transfer belt 12 are removed by the photoconductor cleaner 10.

On the other hand, when the image formation is started, the feed roller 19 starts rotating to feed the sheet P from the sheet tray 18. Conveyance of the sheet P is once stopped by the timing roller pair 20. The timing roller pair 20 restarts rotating at a predetermined timing to feed the sheet P to the secondary transfer nip in synchronization with an entry of the composite toner image on the intermediate transfer belt 12 into the secondary transfer nip.

At that time, a predetermined voltage is applied to the secondary transfer roller 14, and thus a transfer electric field is formed in the secondary transfer nip. The composite toner image is transferred from the intermediate transfer belt 12 onto the sheet P at a time by the transfer electric field formed in the secondary transfer nip. Residual toner particles remaining on the intermediate transfer belt 12 without being transferred onto the sheet P are removed by the belt cleaner 17.

The sheet P is then conveyed to the fixing device 21. The fixing roller 22 and the pressure roller 23 heat and pressurize the toner image to fix the toner image on the sheet P. The ejection roller pair 24 ejects the sheet P from the printer onto the ejection tray 25.

It is to be noted that, although the description above performs multicolor image formation, alternatively, the printer can form single-color images, bicolor images, or three-color images using one, two, or three of the four process units 6Y, 6M, 6C, and 6Bk.

Referring to FIG. 1, the printer includes an apparatus body 100 and a cover 101 to open and close an upper part of the apparatus body 100. The cover 101 is revolvable upward and downward about a revolving shaft 103 disposed in the apparatus body 100. Below the cover 101, a container holder 102 to detachably hold the four toner cartridges 26 is disposed. The container holder 102 is revolvable upward and downward about another revolving shaft 104 disposed in the apparatus body 100.

Figure 2:
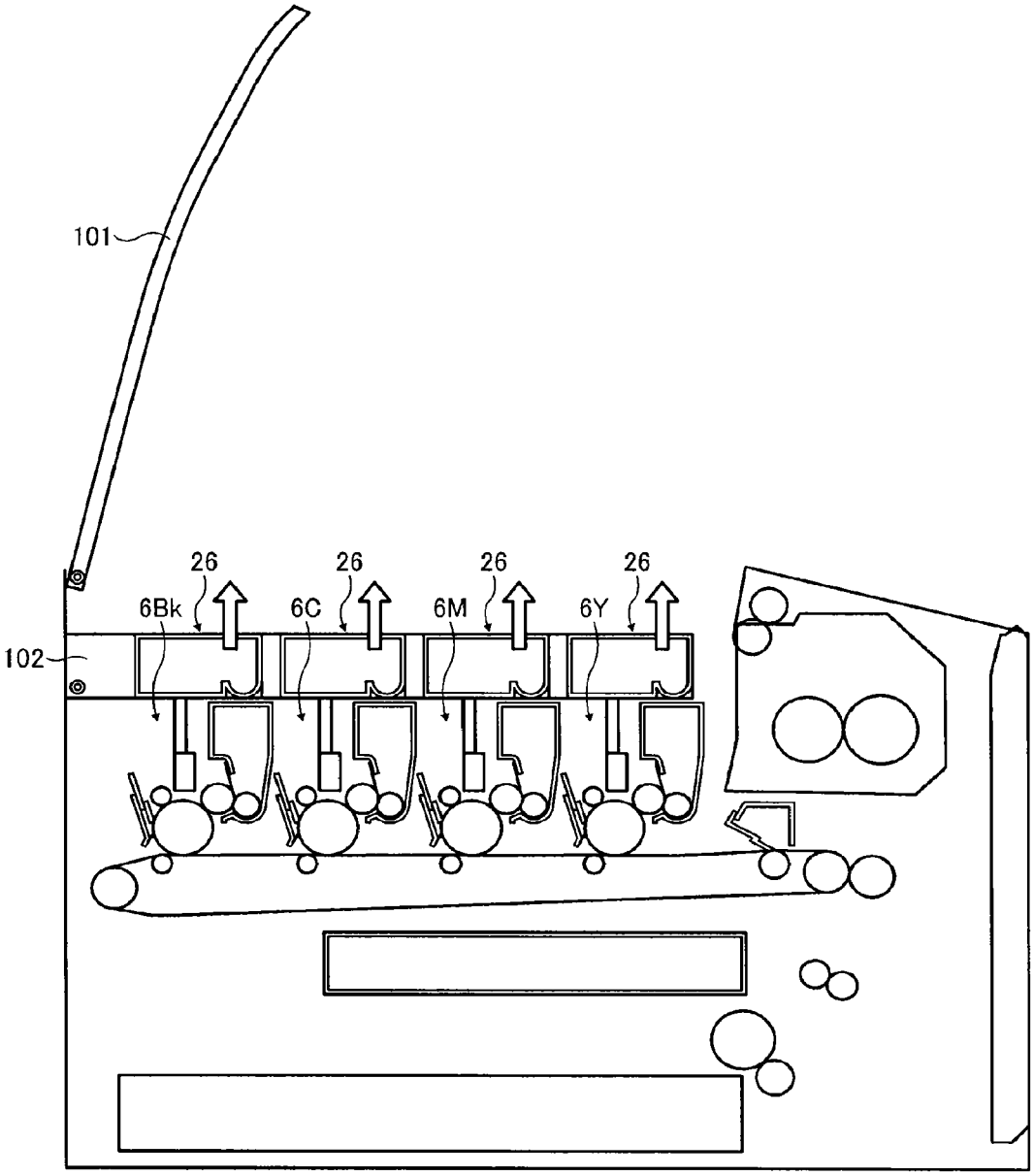
FIG. 2 is a schematic view of the image forming apparatus illustrated in FIG. 1 in a state in which a cover is opened.
Figure 3:
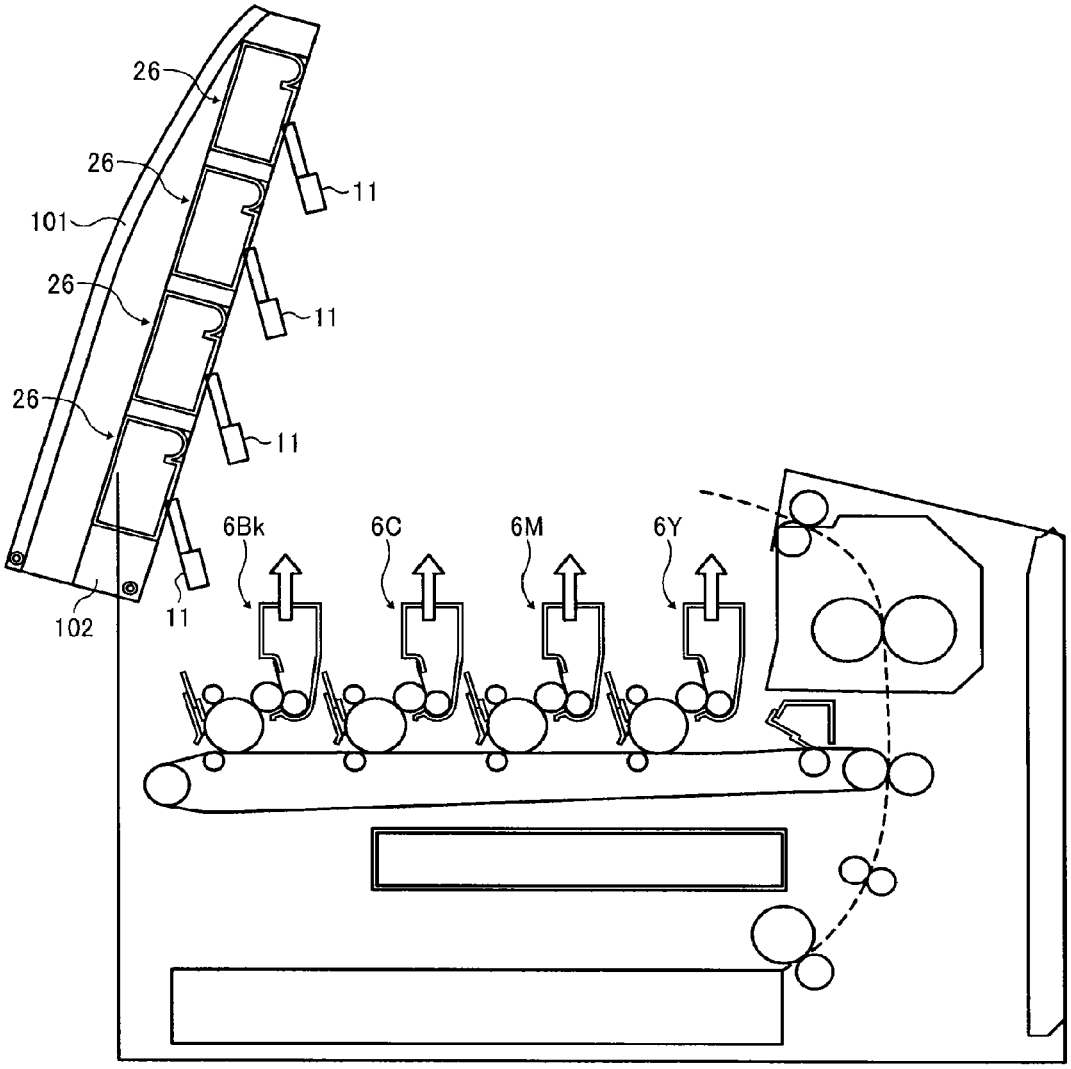
FIG. 3 is a schematic view of the image forming apparatus illustrated in FIG. 1 in a state in which the cover is opened and a container holder is revolved upward.

FIG. 2 is a schematic view of the image forming apparatus illustrated in FIG. 1 with the cover 101 revolved upward. FIG. 3 is a schematic view of the image forming apparatus with both the cover 101 and the container holder 102 revolved upward.

When the cover 101 is revolved upward as illustrated in FIG. 2, an upper part of the apparatus body 100 is opened. Thus, the toner cartridges 26 can be taken out from the container holder 102 upward through the opened part.

When the container holder 102 is revolved upward, as illustrated in FIG. 3, from its default position at which the container holder 102 is horizontally disposed, the toner cartridges 26 along with the container holder 102 are retreated upward from the process units 6Y, 6M, 6C, and 6Bk to be in retreat positions. The irradiators 11, disposed on the lower surface of the container holder 102, are also retreated upward from the process units 6Y, 6M, 6C, and 6Bk as the container holder 102 is revolved. When the container holder 102 is revolved upward to be in a retreat position, the process units 6Y, 6M, 6C, and 6Bk can be taken out through the opened part of the apparatus body 100 without causing interference with the toner cartridges 26 or the irradiators 11.

Figure 4:
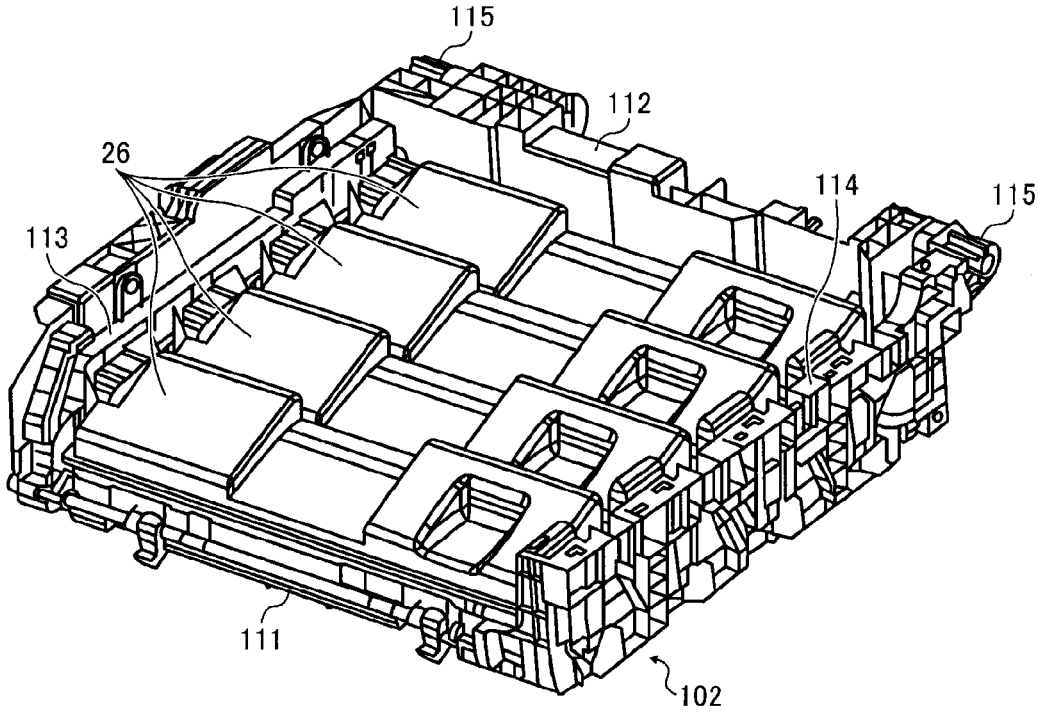
FIG. 4 is a perspective view of the container holder in the image forming apparatus illustrated in FIG. 1.

FIG. 4 is a perspective view of the container holder 102.

Referring to FIG. 4, the container holder 102 includes a bottom 111 having a substantially rectangular shape, a back wall 112 provided to one side of the bottom 111, and a pair of side walls 113 and 114 respectively provided to two opposing sides of the bottom 111 intersecting with the back wall 112. The toner cartridges 26 are mounted to between the pair of side walls 113 and 114 parallel to each other. In addition, a bearing 115 having a cylindrical shape, into which the revolving shaft 104 is inserted, is provided to the back wall 112.

Descriptions are given below of the toner cartridge 26 and the developing device 9.

In the descriptions below, "vertical direction" with respect to the toner cartridge 26 and the developing device 9 is defined when they are mounted to the apparatus body 100. When it is described that "the toner cartridge 26 is mounted to the apparatus body 100", it means that the toner cartridge 26 is in the default position at which the container holder 102 is horizontally disposed.

Figure 5:
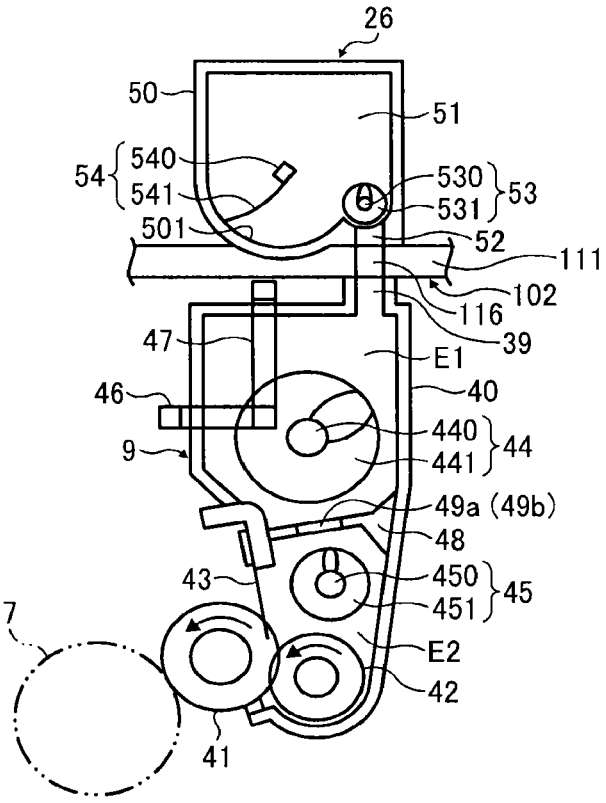
FIG. 5 is a cross-sectional view of a toner cartridge and a developing device according to an embodiment of the present invention.

FIG. 5 is a schematic cross-sectional view of the toner cartridge 26 and the developing device 9.

Referring to FIG. 5, the toner cartridge 26 includes a container body 50 in which a developer storage 51 for storing toner (developer) is formed. The container body 50 has a discharge opening 52 through which toner is discharged from the developer storage 51 outside. The container body 50 includes a conveyance screw 53 and an agitator 54. The conveyance screw 53 conveys toner inside the developer storage 51 to the discharge opening 52. The agitator 54 agitates toner inside the developer storage 51.

The conveyance screw 53 includes a rotary shaft 530 and a spiral blade 531 winding around the outer circumference of the rotary shaft 530. The agitator 54 includes a rotary shaft 540 parallel to the rotary shaft 530 of the conveyance screw 53 and a planar blade 541 provided to the rotary shaft 540. The planar blade 541 is made of a flexible material, such as PET (polyethylene terephthalate) film. When a bottom face 501 of the developer storage 51 is curved into an arc in conformity with an orbit of rotation of the blade 541 as illustrated in FIG. 5, the amount of toner which is not moved but remains inside the developer storage 51 can be reduced.

On the bottom 111 of the container holder 102 to which the toner cartridge 26 is mounted, a through hole 116 is formed. The through hole 116 connects the discharge opening 52 on a lower part of the toner cartridge 26 with a supply opening 39 on an upper part of the developing device 9. More specifically, as illustrated in FIG. 5, when the toner cartridge 26 is mounted to the container holder 102 and disposed above the developing device 9, the discharge opening 52 of the toner cartridge 26 becomes communicated with the supply opening 39 of the developing device 9 through the through hole 116. This configuration makes it possible to supply toner from the toner cartridge 26 to the developing device 9.

The developing device 9 includes a development housing 40 serving as the powder container for storing toner (developer), a developing roller 41 for bearing toner (developer), a supply roller 42 for supplying toner (developer) to the developing roller 41, a doctor blade 43 to regulate the amount of toner (developer) carried on the developing roller 41, two conveyance screws 44 and 45 for conveying toner (developer), and two light guides 46 and 47.

The space within the development housing 40, serving as the powder storage, is divided by a partition 48 into a first compartment (upper compartment) E1 and a second compartment (lower compartment) E2. The partition 48 has two communication openings 49*a* and 49*b*. The communication openings 49*a* and 49*b* are respectively formed at each end portion of the partition 48 in the direction perpendicular to the paper plane on which FIG. 5 is drawn. The first compartment E1 and the second compartment E2 are in communication with each other through the communication openings 49*a* and 49*b*.

In the first compartment E1, the two light guides 46 and 47 and the conveyance screw 44 are disposed. In the second compartment E2, the developing roller 41, the supply roller 42, the doctor blade 43, and the conveyance screw 45 are disposed. The conveyance screw 44 includes a rotary shaft 440 and a spiral blade 441 winding around the outer circumference of the rotary shaft 440. Similarly, the conveyance screw 45 includes a rotary shaft 450 and a spiral blade 451 winding around the outer circumference of the rotary shaft 450. The conveyance screws 44 and 45 convey toner inside the first compartment E1 and the second compartment E2, respectively, in opposite directions.

When toner conveyed by the conveyance screws 44 and 45 in opposite directions reaches downstream end portions of the first and second compartments E1 and E2, respectively, relative to the direction of conveyance of toner (hereinafter "toner conveyance direction"), the toner is forwarded to the other compartment E2 and E1, respectively, through the respective communication openings 49*a* and 49*b* formed at the either end portion of the partition 48. Thus, toner is circulated between the first compartment E1 and the second compartment E2. Since fresh toner supplied from the toner cartridge 26 and the toner inside the development housing 40 are mixed with each other by the circulation, the ratio of fresh toner in the toner inside the development housing 40 can become uniform, thus reducing color unevenness and background fouling in output images.

The developing roller 41 can include a metallic cored bar and a conductive rubber layer overlying the cored bar. Examples of the conductive rubber include, but are not limited to, conductive urethane rubber and silicone rubber. The developing roller 41 rotates counterclockwise in FIG. 5 and conveys the developer carried thereon to a position facing the doctor blade 43 and a position facing the photoconductor 7.

The supply roller 42 can be a sponge roller. Preferred sponge roller includes a metallic cored bar and a semiconductive foamed polyurethane adhering to the cored bar. Foamed polyurethane can be made semiconductive by mixing carbon therein. The supply roller 42 is disposed in contact with the developing roller 41 to form a nip therebetween. The size of the nip is typically about 1 to 3 mm.

The doctor blade 43 can be composed of a plate of a metal, such as stainless steel (SUS), having a thickness of about 0.1 mm. One end of the doctor blade 43 is in contact with a surface of the developing roller 41, forming a regulation nip therebetween. The doctor blade 43 controls the amount of toner carried on the developing roller 41 for the purpose of stabilizing developing property and improving image quality. For example, some marketed products of the image forming apparatus are strictly controlled so that the doctor blade 43 contacts the developing roller 41 at a pressure of about 20 to 60 N/m and the regulation nip is positioned 0.5±0.5 mm away from the end of the doctor blade 43. These parameters can be determined in accordance with properties of developer (toner), the developing roller, and the supply roller.

Development operation of the above-described developing device 9 is described below with reference to FIG. 5.

When the developing roller 41 and the supply roller 42 start rotating in response to a start command, the supply roller 42 supplies toner to the surface of the developing roller 41. The supply roller 42 rotates so as to face in the direction of rotation of the developing roller 41 (i.e., counterclockwise in FIG. 5), thus efficiently supplying the toner in the development housing 40 to the outer layer of the developing roller 41. Additionally, in the present embodiment, the rotational frequency ratio between the developing roller 41 and the supply roller 42 is set to 1 so that toner can be supplied reliably.

While toner carried on the developing roller 41 passes through the nip between the developing roller 41 and the doctor blade 43, the amount of toner is adjusted. Simultaneously, toner is charged through friction. When toner on the developing roller 41 reaches the position facing the photoconductor 7 (i.e., a development range), the toner electrostatically moves to the electrostatic latent image formed on the photoconductor 7, thus developing it into a toner image.

Next, supply of toner to the developing device 9 is described in further detail below.

When the amount of toner inside the development housing 40 falls below a reference amount, toner is supplied to the developing device 9. Whether or not the amount of toner is smaller than the reference amount can be determined based on whether light is transmittable between the ends of the two light guides 46 and 47 disposed in the first compartment E1. When the amount of toner in the development housing 40 is equal to or greater than the reference amount, it means toner stands between the ends of the light guides 46 and 47 to prevent light from transmitting from one of the light guides to the other. By contrast, when the amount of toner is smaller than the reference amount, it means no toner stands between the ends of the light guides 46 and 47, allowing light to transmit from one of the light guides to the other. In response to detection of transmission of light, a toner supply timing is obtained.

When it is determined that it is the toner supply timing, the conveyance screw 53 inside the toner cartridge 26 starts rotating and conveys toner to the discharge opening 52. The conveyed toner is discharged from the discharge opening 52 and supplied to the development housing 40 via the through hole 116 and the supply opening 39. More specifically, as the agitator 54 rotates, toner inside the toner cartridge 26 is agitated and conveyed toward the conveyance screw 53. When the amount of toner inside the development housing 40 exceeds the reference amount, the conveyance screw 53 and the agitator 54 stop rotating. Thus, toner supply is completed.

A related-art developing device is described below with reference to FIG. 6.

Figure 6:
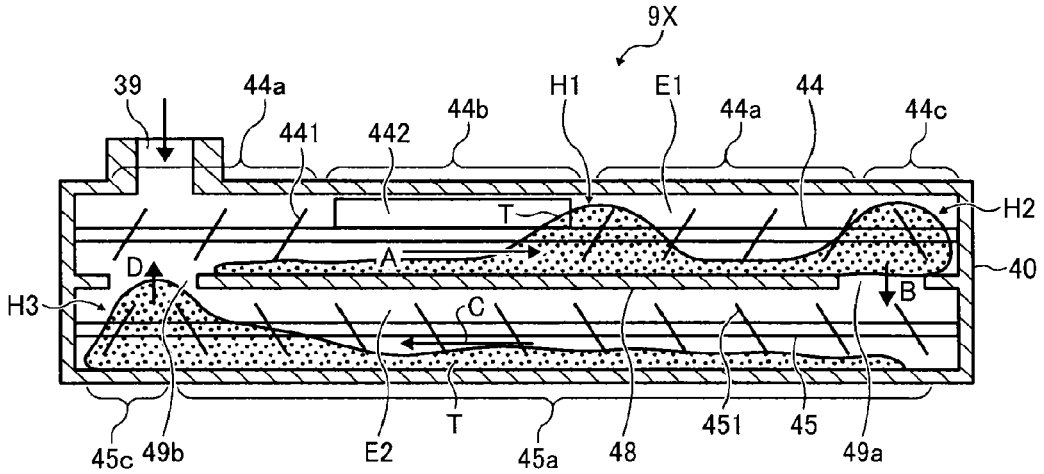
FIG. 6 RELATED ART
FIG. 6 is a cross-sectional view of a related-art developing device.

FIG. 6 is a cross-sectional view of a related-art developing device 9X taken along the axial direction of conveyance screws 44 and 45. Hereinafter, for the sake of simplicity, the same reference number will be given to identical constituent elements such as parts and materials having the same functions as those of the above-described developing device 9 according to an embodiment of the present invention and redundant descriptions thereof omitted unless otherwise stated.

Referring to FIG. 6, in the related-art developing device 9X, the inner space of the development housing 40 is divided by the partition 48 into the first compartment (upper compartment) E1 and the second compartment (lower compartment) E2, in a similar way to the above-described developing device 9. The first compartment E1 and the second compartment E2 are horizontally extended and communicated with each other in the vertical direction through the communication openings 49*a* and 49*b* provided to respective ends of the partition 48.

The conveyance screws 44 and 45 are respectively disposed in the first compartment E1 and the second compartment E2. The conveyance screws 44 and 45 horizontally convey toner T in opposite directions indicated by arrows A and C, respectively, in FIG. 6. As toner T is supplied from the supply opening 39 formed on an upstream side of the first compartment E1 relative to the toner conveyance direction, the conveyance screw 44 disposed in the first compartment E1 conveys the toner T in the direction indicated by arrow A. The toner T then falls down in the direction indicated by arrow B through the communication opening 49*a* formed on a downstream side of the first compartment E1 relative to the toner conveyance direction, being supplied to the second compartment E2. The toner T supplied to the second compartment E2 is conveyed in the direction indicated by arrow C by the conveyance screw 45 disposed in the second compartment E2. The toner T is then pushed up in the direction indicated by arrow D through the communication opening 49*b* formed on a downstream side of the second compartment E2 relative to the toner conveyance direction, being returned to the first compartment E1. Thus, toner T is circulated between the first compartment E1 and the second compartment E2 while being mixed.

Referring to FIG. 6, the conveyance screws 44 and 45 have reverse winding parts 44*c* and 45*c*, respectively, in each of which the direction of winding of spiral blade is reversed, on their downstream ends relative to the toner conveyance direction. In the reverse winding parts 44*c* and 45*c*, toner T is conveyed in the direction opposite to the toner conveyance direction in upstream sides. Thus, particles of toner T collide with each other in these parts. Collision of toner particles generates a conveyance force which conveys toner T in the direction intersecting with the axial direction of the conveyance screws 44 and 45. The conveyance force allows toner T to more easily fall down or to be pushed up.

Additionally, in the related-art developing device 9X, the conveyance screw 44 disposed in the first compartment E1 has a part in which the spiral blade 441 is omitted. Instead, the conveyance screw 44 has an agitation part 44*b* in which a planar blade 442 is provided in the axial direction. In the agitation part 44*b*, as the planar blade 442 rotates as the conveyance screw 44 rotates, toner T is moved mainly in the peripheral direction, thereby being agitated. Namely, the conveyance screw 44 disposed in the first compartment E1 has a conveyance part 44*a* and the agitation part 44*b*. In the conveyance part 44*a*, the spiral blade 441 generates a conveyance force to convey toner T in the axial direction. In the agitation part 44*b*, the planar blade 442 generates an agitation force to move toner T in the peripheral direction.

Referring to FIG. 6, the agitation part 44*b* is disposed around the middle part of the conveyance screw 44 in the axial direction. As toner T is supplied from the supply opening 39, the upstream conveyance part 44*a* conveys the toner T downstream to the agitation part 44*b*. After the toner T is agitated in the agitation part 44*b*, the downstream conveyance part 44*a* further conveys the toner T downstream to the communication opening 49*a*. In the example illustrated in FIG. 6, the conveyance screw 45 disposed in the second compartment E2 has no agitation part, but may include an agitation part in which a planar blade is disposed.

As described above, in the related-art developing device 9X, toner T is circulated between the first compartment E1 and the second compartment E2. However, there are some portions in the first compartment E1 and the second compartment E2 in which toner T easily accumulates. Specifically, such portions include a portion H1 in the vicinity of the agitation part 44*b*, a portion H2 in the vicinity of the communication opening 49*a* through which toner T falls down, and a portion H3 in the vicinity of the communication opening 49*b* through which toner T is pushed up. At the agitation part 44*b*, it is difficult to generate a conveyance force which conveys toner in the axial direction since no spiral blade 441 is provided to the conveyance screw 44. At the communication openings 49*a* and 49*b*, toner conveyance speed becomes slow since toner is moved in the direction intersecting with the axial direction of the conveyance screws 44 and 45. Therefore, while being continuously conveyed from upstream sides, toner T easily accumulates in such portions. As toner T accumulates in such portions to some extent, the accumulated toner T prevents the air moved from upstream sides along with toner T from flowing downstream, thereby increasing the inner pressure at upstream sides of the toner-accumulated portions. As a result, toner T may be pressurized by the increased inner pressure to aggregate and prevented from being smoothly conveyed.

To prevent such defective conveyance of toner, the developing device 9 according to an embodiment of the present invention has the following configuration.

Figure 7:
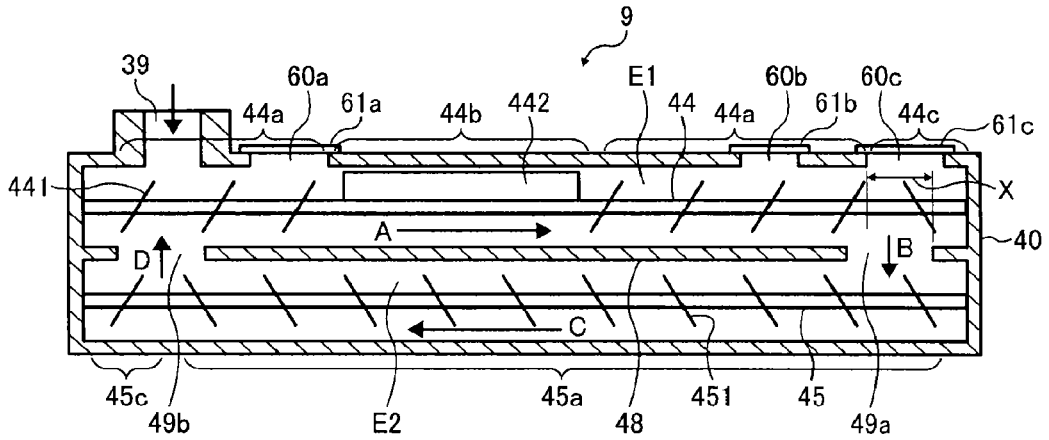
FIG. 7 is a schematic cross-sectional view of the developing device illustrated in FIG. 5 taken along the axial direction of conveyance screws.
Figure 8:
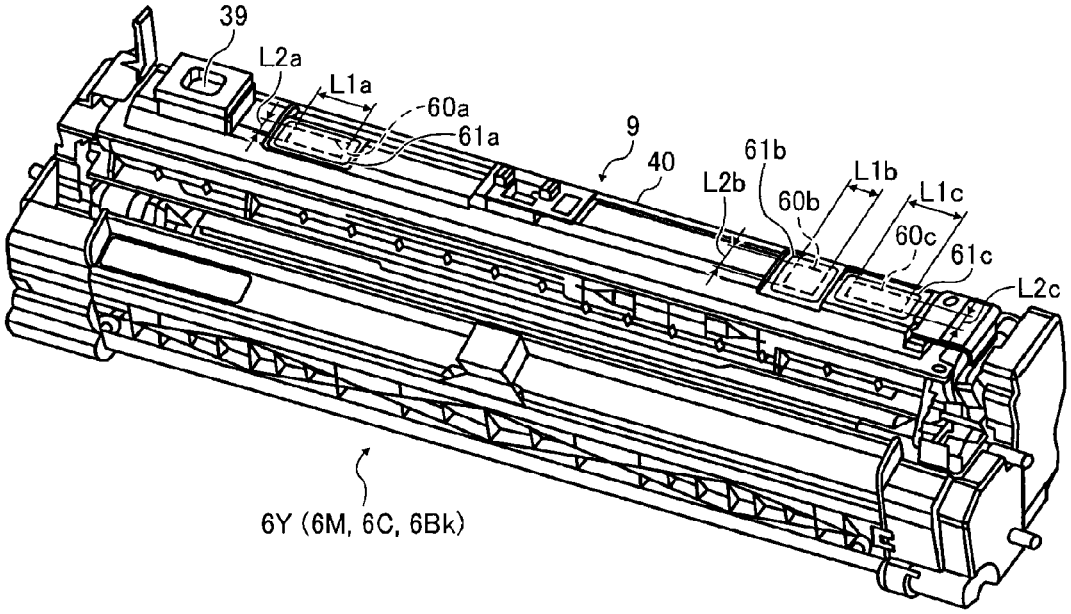
FIG. 8 is a perspective view of the developing device illustrated in FIG. 5.

FIG. 7 is a schematic cross-sectional view of the developing device 9 taken along the axial direction of the conveyance screws 44 and 45. FIG. 8 is a perspective view of the developing device 9.

Referring to FIG. 7, the developing device 9 has three vent holes 60*a*, 60*b*, and 60*c* to pass air inside and outside the development housing 40 and ventilation sheets 61*a*, 61*b*, and 61*c* to cover the respective vent holes 60*a*, 60*b*, and 60*c*. The developing device 9 has a similar configuration to the related-art developing device 9X except for having the vent holes 60*a*, 60*b*, and 60*c* and the ventilation sheets 61*a*, 61*b*, and 61*c*. Hereinafter, for the sake of simplicity, the vent hole 60*a* closest to the supply opening 39, the vent hole 60*b* second closest to the supply opening 39, and the vent hole 60*c* farthest from the supply opening 39 are respectively referred to as first, second, and third vent holes.

The vent holes 60*a*, 60*b*, and 60*c* are formed upstream from the portions in which toner easily accumulates, relative to the toner conveyance direction, for effectively suppressing an increase of the inner pressure within the development housing 40 (i.e., the first compartment E1 and the second compartment E2) in the developing device 9.

More specifically, the first vent hole 60*a* is provided downstream from the supply opening 39 and upstream from the agitation part 44*b* relative to the toner conveyance direction. The second vent hole 60*b* is provided downstream from the agitation part 44*b* and upstream from the communication opening 49*a*, through which toner falls down, relative to the toner conveyance direction. The third vent hole 60*c* is provided downstream from the second vent hole 60*b* and upstream from the communication opening 49*b*, through which toner is pushed up, relative to the toner conveyance direction. Here, the toner conveyance direction is defined as a direction of conveyance of toner supplied from supply opening 39. Hereinafter, the communication opening 49*a* through which toner falls down may be referred to as "fall port 49*a*", and the communication opening 49*b* through which toner is pushed up may be referred to as "push-up port 49*b*".

The vent holes 60*a*, 60*b*, and 60*c* and the ventilation sheets 61*a*, 61*b*, and 61*c* are provided on the upper surface of the development housing 40 so as not to be clogged with toner. More specifically, the vent holes 60*a*, 60*b*, and 60*c* are provided on the upper surface of the development housing 40 that faces the conveyance screw 44 in the first (upper) compartment E1. Among the three vent holes 60*a*, 60*b*, and 60*c*, the third vent hole 60*c* is provided above the fall port 49*a*. In particular, at least a part of the third vent hole 60*c* is overlapped with (or facing) the fall port 49*a* in the vertical direction, as is indicated by a range X in FIG. 7.

Referring to FIG. 8, in the present embodiment, the first vent hole 60*a* and the third vent hole 60*c* each have a rectangular shape longer in the toner conveyance direction (or in the longitudinal direction of the developing device 9), and the second vent hole 60*b* has a square shape. More specifically, the vent holes 60*a*, 60*b*, and 60*c* have first lengths L1*a*, L1*b*, and L1*c*, respectively, in the toner conveyance direction and second lengths L2*a*, L2*b*, and L2*c*, respectively, in the direction perpendicular to the toner conveyance direction, and the first lengths are equal to or longer than the corresponding second length, i.e., L1*a*>L2*a*, L1*b*=L2B, and L1*c*>L2*c* are satisfied. Owing to this configuration, even when a large amount of toner accumulates downstream, the vent holes 60*a*, 60*b*, and 60*c* are prevented from being clogged with the accumulated toner and maintain ventilation property. In particular, the first vent hole 60*a* and the third vent hole 60*c*, having the respective first lengths L1*a* and L1*c* in the toner conveyance direction longer than the respective second lengths L2*a* and L2*c* in the direction perpendicular to the toner conveyance direction (i.e., L1*a*>L2*a*, L1*c*>L2*c*), are more effectively prevented from being clogged with the accumulated toner.

When the sizes of the vent holes 60*a*, 60*b*, and 60*c* are too large, user is more likely to touch the ventilation sheets 61*a*, 61*b*, and 61*c* when detaching or attaching the process units from/to the image forming apparatus, possibly damaging the ventilation sheets 61*a*, 61*b*, and 61*c*. In view of this situation, the sizes of the vent holes 60*a*, 60*b*, and 60*c* are preferably as small as possible. In the present embodiment, the second vent hole 60*b* is shorter than the adjacent third vent hole 60*c* in the toner conveyance direction, i.e., L1*b*<L1*c*. This configuration prevents excessive enlargement of the vent holes 60*b* and 60*c*. By contrast, the second vent hole 60*b* is longer than the third vent hole 60*c* in the direction perpendicular to the toner conveyance direction, i.e., L2*b*>L2*c*. This configuration secures the ventilation quantity of the second vent hole 60*b*.

Figure 9:
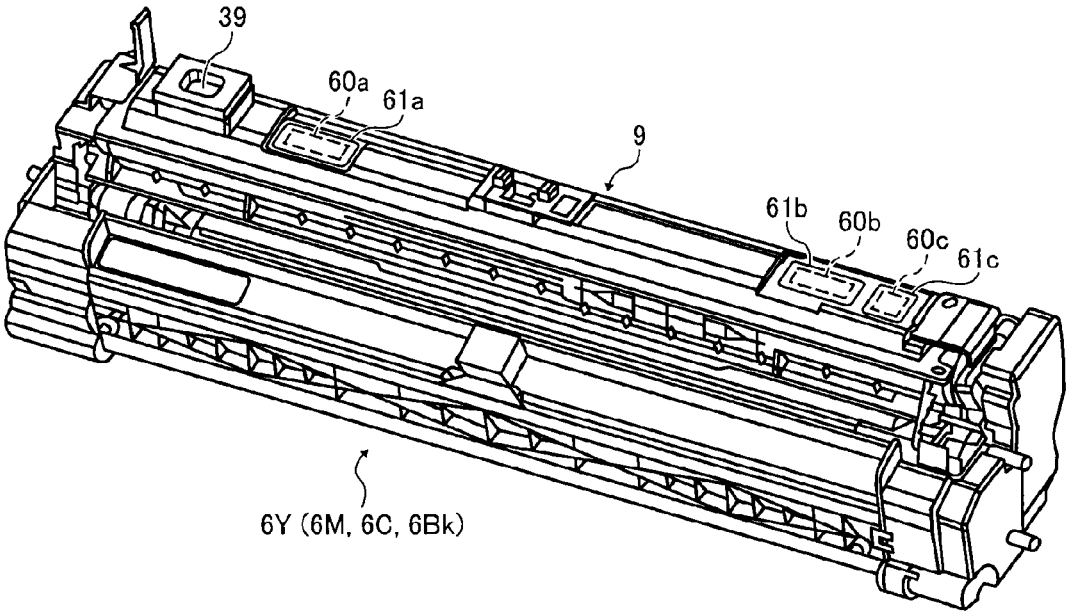
FIG. 9 is a perspective view of a developing device according to another embodiment of the present invention.
Figure 10:
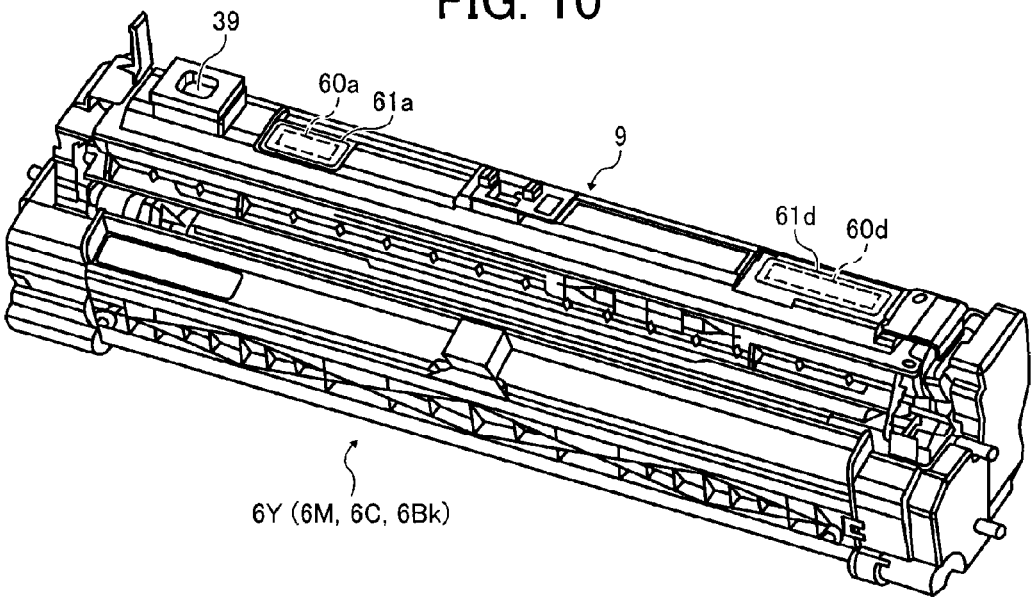
FIG. 10 is a perspective view of a developing device according to another embodiment of the present invention.

The shapes and sizes of the vent holes 60*a*, 60*b*, and 60*c* are determined in view of securement of ventilation property and prevention of damage caused by user, as described above, but are not limited to particular shapes and sizes. For example, it is possible that the second vent hole 60*b* is formed into a rectangular shape longer in the toner conveyance direction and the third vent hole 60*c* is formed into a square shape, as illustrated in FIG. 9. Alternatively, it is also possible that the second vent hole 60*b* and the third vent hole 60*c* are integrally combined into a single vent hole 60*d* that is covered with a single ventilation sheet 61*d*, as illustrated in FIG. 10. It is also possible that each of the vent holes 60*a*, 60*b*, and 60*c* has a shape other than a rectangular or square shape, such as a circular shape and a shape of an ellipse.

The ventilation sheets 61*a*, 61*b*, and 61*c* may be composed of porous films made of a resin. The ventilation sheets 61*a*, 61*b*, and 61*c* allow air but do not allow toner to pass through. The ventilation sheets 61*a*, 61*b*, and 61*c* are preferably composed of oil-repellent sheets to which toner is less likely to adhere, to prevent deterioration of ventilation property.

Figure 11A:
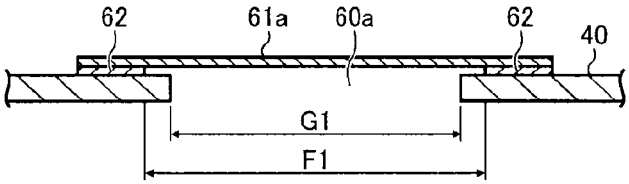
FIGS. 11A and 11B are cross-sectional side view and plan view, respectively, of a ventilation sheet attached to a development housing according to an embodiment of the present invention.
Figure 11B:
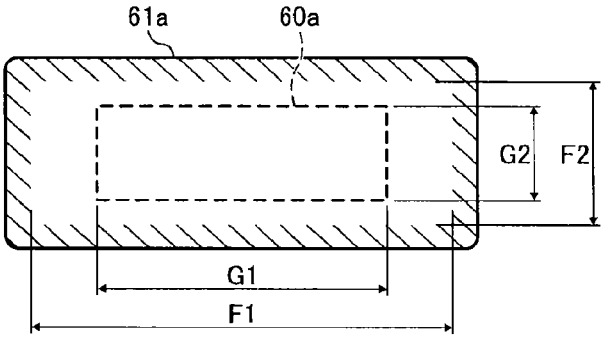

An attachment structure of the ventilation sheet to the development housing 40 is illustrated in FIGS. 11A and 11B.

FIGS. 11A and 11B are cross-sectional side view and plan view, respectively, of the ventilation sheet 61*a* attached to the development housing 40. Since the ventilation sheets 61*a*, 61*b*, and 61*c* have the same configuration, only the ventilation sheet 61*a* is illustrated and the ventilation sheets 61*b* and 61*c* are omitted in FIGS. 11A and 11B.

Referring to FIG. 11A, the ventilation sheet 61*a* is attached to the outer surface of the development housing 40 via a double-sided adhesive tape 62. The double-sided adhesive tape 62 can be replaced with another adhesive member, such adhesive and glue.

In FIG. 11B, a shaded area represents an area to which the double-sided adhesive tape 62 is attached. The ventilation sheet 61*a* is greater than the vent hole 60*a* in both longitudinal and transverse directions. The double-sided adhesive tape 62 is attached to the whole circumferential edge of the ventilation sheet 61*a*. The double-sided adhesive tape 62 is not overlapped with the vent hole 60*a* so as not to degrade ventilation property of the vent hole 60*a*. Namely, the double-sided adhesive tape 62 is attached to the ventilation sheet 61*a* in such a manner that an air-permeable area of the ventilation sheet 61*a* (i.e., an area to which the double-sided adhesive tape 62 is not attached) becomes greater than the aperture of the vent hole 60*a*, i.e., F1≥G1 and F2≥G2 are satisfied.

Function effects of the vent holes 60*a*, 60*b*, and 60*c* are described below with reference to FIG. 12.

When toner T is circulated within the developing device 9, toner T accumulates in large amounts in the portion H1 in the vicinity of the agitation part 44*b*, the portion H2 in the vicinity of the communication opening 49*a* through which toner T falls down, and the portion H3 in the vicinity of the communication opening 49*b* through which toner T is pushed up, similar to the case in which toner T is circulated within the related-art developing device 9X illustrated in FIG. 6. The developing device 9 according to an embodiment of the present invention is different from the related-art developing device 9X in that the vent holes 60*a*, 60*b*, and 60*c* are provided upstream from the portions (hereinafter "accumulation portions") H1, H2, and H3 in which toner T easily accumulates. Owing to this configuration, the air moved along with toner as the toner is conveyed within the conveyance path is discharged outside through the vent holes 60*a*, 60*b*, and 60*c*.

More specifically, the air on upstream sides from the accumulation portion H1 in the vicinity of the agitation part 44*b* is discharged through the first vent hole 60*a*. The air on upstream sides from the accumulation portion H2 in the vicinity of the fall port 49*a* is discharged through the second vent hole 60*b*. The air on upstream sides from the accumulation portion H3 in the vicinity of the push-up port 49*b* is discharged through the third vent hole 60*c*. Although it looks as if the fall port 49*a* was clogged with the accumulated toner T in FIG. 12, the fall port 49*a* almost never becomes clogged with toner T in actual. The air in the second compartment E2 can be discharged from the third vent hole 60*c* through the fall port 49*a*. Since the third vent hole 60*c* is overlapped with the fall port 49*a* in the present embodiment, the air in the second compartment E2 can be more easily discharged from the third vent hole 60*c* through the fall port 49*a*.

Figure 12:
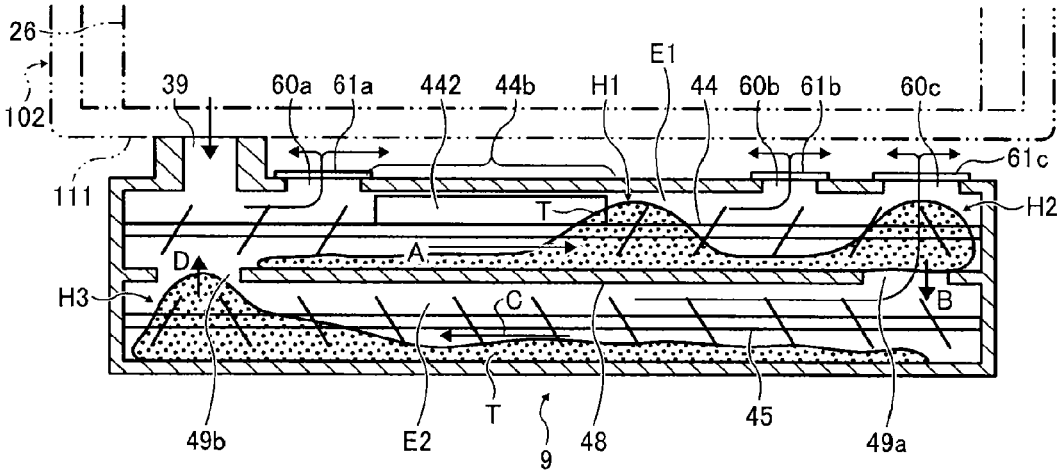
FIG. 12 a schematic cross-sectional view of a developing device according to an embodiment of the present invention.

As illustrated in FIG. 12, the container holder 102 holding the toner cartridge 26 (shown by two-dot chain lines) is disposed above the developing device 9 while forming a gap between the bottom 111 of the container holder 102 and the upper surface of the developing device 9. Owing to the presence of the gap, the vent holes 60*a*, 60*b*, and 60*c* are never covered with the bottom 111 of the container holder 102 although the container holder 102 is disposed above the developing device 9. Thus, the air discharged from the vent holes 60*a*, 60*b*, and 60*c* can flow out through the gap.

The developing device 9 according to an embodiment of the present invention is capable of suppressing an increase of the inner pressure of the conveyance path (i.e., the first compartment E1 and the second compartment E2) since the air moved along with toner can be discharged outside through the vent holes 60*a*, 60*b*, and 60*c*. Thus, in the developing device 9, toner is prevented from aggregating, toner fluidity is secured, and smooth conveyance of toner can be performed for an extended period of time.

Figure 13:
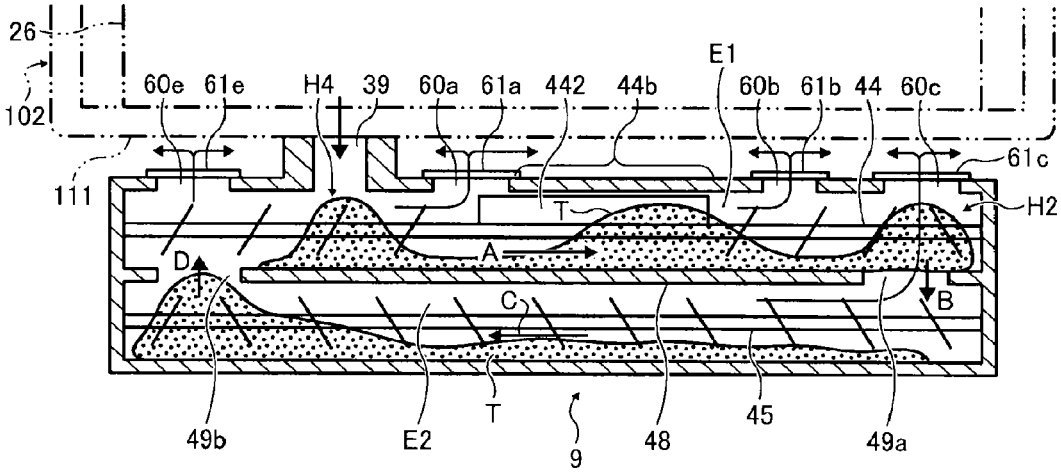
FIG. 13 is a schematic cross-sectional view of a developing device according to another embodiment of the present invention.

FIG. 13 is a schematic cross-sectional view of the developing device 9 according to another embodiment of the present invention.

The developing device 9 illustrated in FIG. 13 is different from that illustrated in FIG. 12 in that the position of the supply opening 39 is changed. In particular, the position of the supply opening 39 illustrated in FIG. 13 is more downstream than that illustrated in FIG. 12 relative to the toner conveyance direction. Additionally, in the developing device illustrated in FIG. 13, a fourth vent hole 60*e* and a ventilation sheet 61*e* covering the vent hole 60*e* are further provided upstream from the supply opening 39 relative to the toner conveyance direction.

Referring to FIG. 13, toner T supplied from the supply opening 39 may easily accumulates on a position immediately below the supply opening 39. This position is hereinafter referred to as "accumulation portion H4". Since the fourth vent hole 60*e* is provided upstream from the accumulation portion H4 in which toner T easily accumulates, the air moved along with toner is discharged outside through the fourth vent hole 60*e*. Thus, an increase of the inner pressure of the space upstream from the accumulation portion H4 in the vicinity of the supply opening 39 is suppressed, and toner is prevented from aggregating.

According to the present embodiment, since at least a part of the fourth vent hole 60*e* is disposed above the push-up port 49*b*, as toner T is pushed up through the push-up port 49*b*, the air is moved upward along with the toner T and discharged outside through the fourth vent hole 60*e*. Owing to this configuration, it becomes much easier to push up toner T, improving toner conveyance property.

It is to be noted that, other than the differences described above, configuration and operation of elements of the present embodiment are similar to those of the above-described embodiment, attaining similar effects. Thus, descriptions thereof are omitted.

In the above-described embodiments, horizontally-extended conveyance paths (i.e., the first compartment E1 and second compartment E2) are arranged in parallel in the vertical direction. According to another embodiment, the horizontally-extended conveyance paths may be arranged in parallel in a direction intersecting with the extension direction of the conveyance paths. Even in such an embodiment, at a portion where toner is conveyed from one conveyance path to another conveyance path, toner is moved in the direction intersecting with the axial direction of the conveyance screws, and toner conveyance speed becomes slow and toner easily accumulates. When a vent hole is provided to the upper surface of the conveyance path that faces the conveying screw, an increase of the inner pressure is suppressed, preventing aggregation and defective conveyance of toner.

In the above-described embodiments, the agitation part having a planar blade is provided for the purpose of agitating toner. According to another embodiment, the planar blade is provided for another purpose. For example, the planar blade can be provided for the purpose of cleaning light-output or light-input surfaces of the light guides that detect a toner amount. In this case, the planar blade may be disposed in contact with the light-output or light-input surfaces. Even in such an embodiment, at a portion where the planar blade is provided to the conveyance screw (i.e., cleaning part), it is difficult to generate a toner conveyance force to convey toner in the axial direction and toner easily accumulates. When a vent hole is provided, an increase of the inner pressure is suppressed and defective conveyance of toner is prevented.

The vent holes and ventilations sheets having the above-described configurations (as illustrated in FIGS. 7 to 13) can be applied not only to developing devices (development housings) but also to other powder containers, such as toner cartridge and waste-toner container.

Descriptions are given below of a toner cartridge having a vent hole and a ventilation sheet.

It is to be noted that, other than differences described below, configuration and operation of elements of the following embodiments are similar to those of the toner cartridge according to the above-described embodiment, attaining similar effects. Thus, descriptions thereof are omitted.

Figure 14:
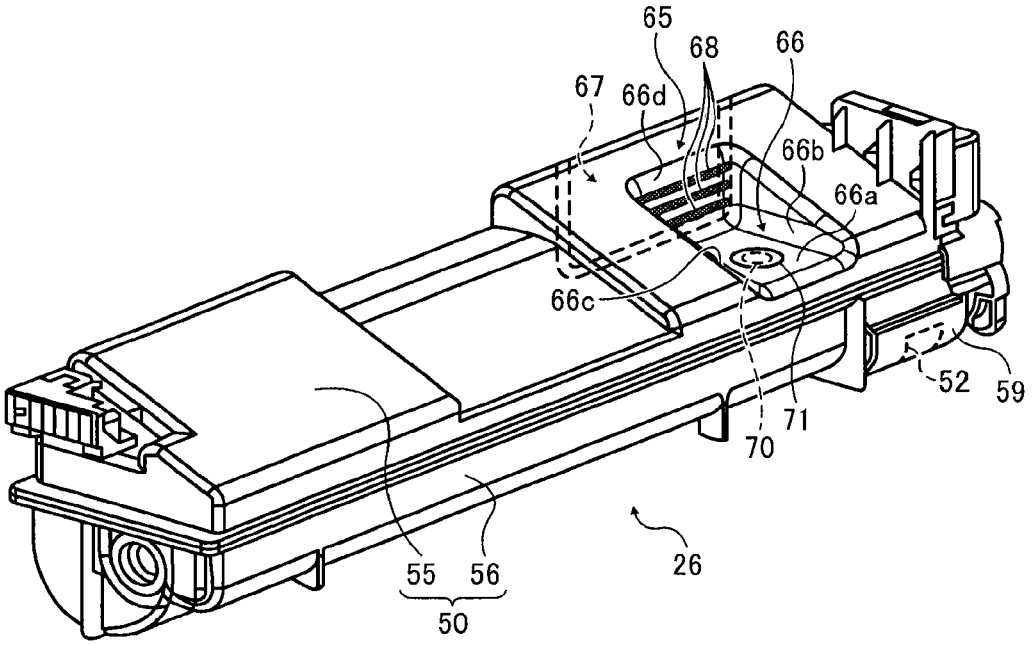
FIG. 14 is a perspective view of a toner cartridge according to an embodiment of the present invention.
Figure 15:
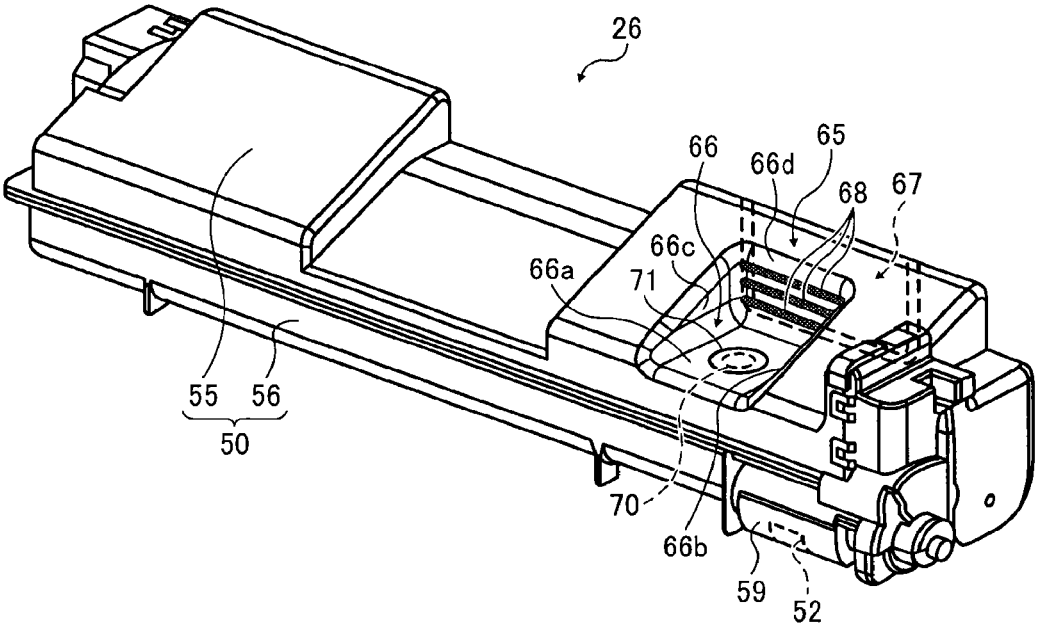
FIG. 15 is another perspective view of the toner cartridge illustrated in FIG. 14.
Figure 16:
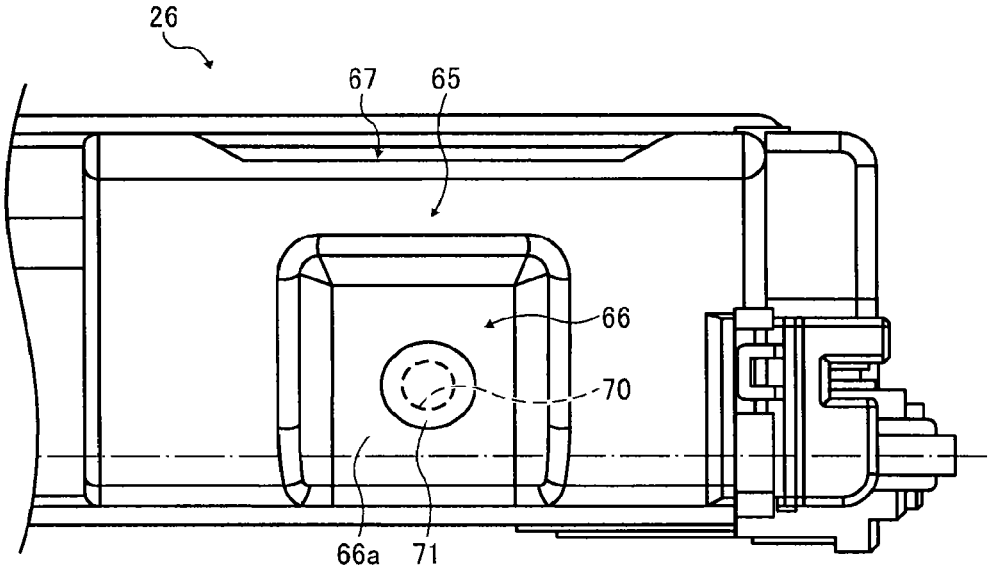
FIG. 16 is a plan view of the toner cartridge illustrated in FIG. 14.
Figure 17:
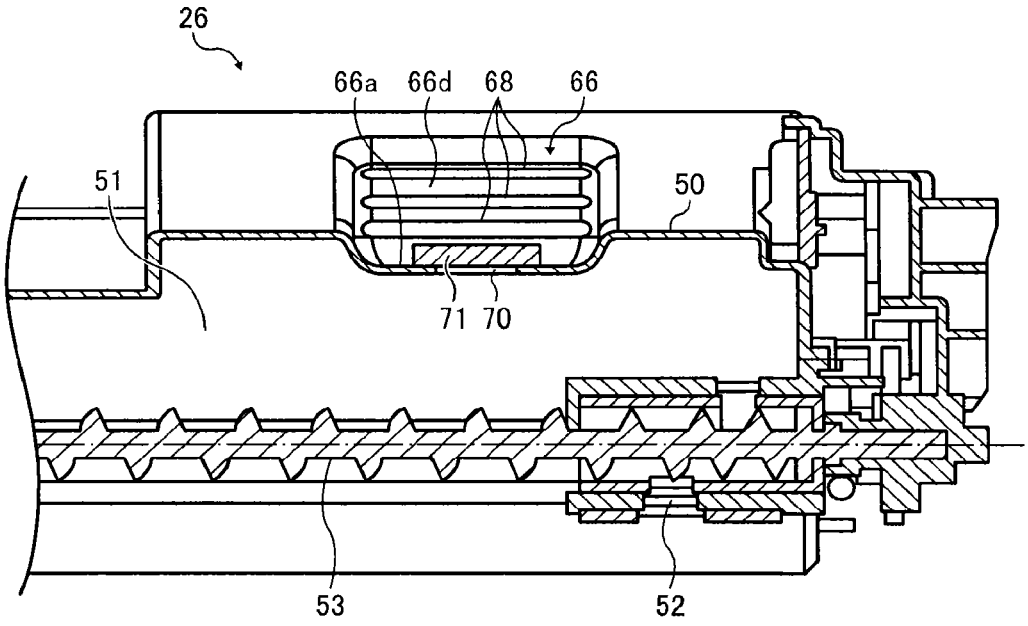
FIG. 17 is a cross-sectional view of the toner cartridge illustrated in FIG. 14 taken along the axial direction of a conveyance screw.

FIGS. 14 and 15 are perspective views of the toner cartridge 26. FIG. 16 is a plan view of the toner cartridge 26. FIG. 17 is a cross-sectional view of the toner cartridge 26 taken along the axial direction of the conveyance screw 53. In each of FIGS. 16 and 17, a dot-and-dash line represents the rotation axis of the conveyance screw 53.

Referring to FIGS. 14 and 15, the toner cartridge 26 includes the container body 50 longitudinally extended. The container body 50 includes an upper case 55 and a lower case 56 bonded to each other. Referring to FIG. 17, the conveyance screw 53 is longitudinally extended inside the developer storage 51 inside the container body 50. The conveyance screw 53 conveys toner inside the developer storage 51 to the discharge opening 52 provided to one end part (right end part in FIGS. 14 and 15) of the container body 50. The container body 50 further includes a shutter 59 to open and close the discharge opening 52.

To the end part of the container body 50 having the discharge opening 52, a vent hole 70 to pass air inside and outside the toner cartridge 26 and a ventilation sheet 71 for covering the vent hole 70 are provided. Similar to the ventilation sheets 61*a*, 61*b*, and 61*c* provided to the above-described developing device 9, the ventilation sheet 71 may be composed of a porous film made of a resin. The ventilation sheet 71 allows air but does not allow toner to pass through. The ventilation sheet 71 is preferably composed of an oil-repellent sheet to which toner is less likely to adhere. In the present embodiment, a single vent hole 70 and a single ventilation sheet 71 are provided. According to another embodiment, multiple vent holes and multiple ventilation sheets may be provided.

As illustrated in FIG. 17, the vent hole 70 and the ventilation sheet 71 are provided on the upper surface of the container body 50 that faces the conveyance screw 53 in the developer storage 51. In particular, the vent hole 70 and the ventilation sheet 71 are provided to an upper surface recess 66 formed on the upper surface of the upper case 55. The upper surface recess 66 and a back surface recess 67 that is formed on the back surface side of the upper case 55, as illustrated in FIGS. 14 to 16, cooperatively serves as a gripper 65 of the toner cartridge 26 to be gripped by user.

More specifically, the upper surface recess 66 is formed with a bottom surface 66*a*, left and right side surfaces 66*b* and 66*c*, and a back side surface 66*d*. The bottom surface 66*a* is disposed horizontally when the toner cartridge 26 is mounted to the apparatus body 100. The left and right side surfaces 66*b* and 66*c* are disposed upright at respective left and right sides of the bottom surface 66*a*. The back side surface 66*d* is disposed upright at the back surface side of the bottom surface 66*a*. In particular, the vent hole 70 and the ventilation sheet 71 are provided to the bottom surface 66*a*. The back side surface 66*d* particularly functions as the gripper 65.

Figure 18:
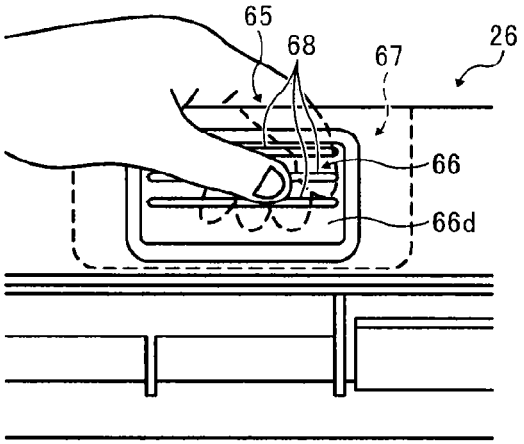
FIG. 18 is an illustration of the toner cartridge illustrated in FIG. 14 when gripped by user.

FIG. 18 is an illustration of the toner cartridge 26 gripped by user.

As illustrated in FIG. 18, user can grip the toner cartridge 26 by pressing a thumb against the back side surface 66*d* of the upper surface recess 66 while pressing fingers other than the thumb against the back surface recess 67. In the present embodiment, multiple ribs 68 are further provided to the back side surface 66*d* to prevent fingers from slipping.

When toner inside a toner cartridge is conveyed by a conveyance screw to a discharge opening of the toner cartridge and supplied to a developing device, the air in the toner cartridge is also pushed out from the toner cartridge along with the toner. As a result, the inner pressure of the toner cartridge is decreased. In a case in which the toner cartridge has no vent hole, as the inner pressure is decreased, air will flow into the toner cartridge through the discharge opening. The incoming air will cause reverse flow and defective conveyance (supply) of the toner.

By contrast, according to an embodiment of the present invention, the toner cartridge 26 has the vent hole 70. Even when the air in the toner cartridge 26 is discharged outside through the discharge opening 52 as the toner is conveyed (supplied) to the developing device 9, it is possible to introduce air inside the toner cartridge 26 through the vent hole 70. Thus, a decrease of the inner pressure of the toner cartridge 26 can be suppressed. In the above-described embodiment, the vent hole 70 is provided on a side closer to the discharge opening 52. Therefore, a decrease of the inner pressure can be effectively suppressed at around the discharge opening 52. According to the above-described embodiment, the toner cartridge 26 can effectively suppresses a decrease of the inner pressure caused when toner is conveyed. Toner is prevented from reversely flowing out through the discharge opening 52 and is reliably conveyed (supplied).

In the above-described embodiment, the vent hole 70 and the ventilation sheet 71 are provided on the upper surface of the container body 50 that faces the conveyance screw 53 in the developer storage 51. Owing to this configuration, the vent hole 70 and the ventilation sheet 71 are less likely to be clogged with toner, and ventilation property is maintained for an extended period of time.

Even in a case in which toner has been adhered to the ventilation sheet 71, it is possible to take off the toner from the ventilation sheet 71 by a vibration caused when user detaches or attaches the toner cartridge 26. In the above-described embodiment, since the gripper 65 is disposed in proximity to the ventilation sheet 71, a vibration caused upon contact of user with the gripper 65 (i.e., the upper surface recess 66 and the back surface recess 67) is easily transmitted to the ventilation sheet 71. Thus, toner adhered to the ventilation sheet 71 can be effectively taken off to recover ventilation property of the ventilation sheet 71.

In the above-described embodiment, since the ventilation sheet 71 is provided to the bottom surface 66*a* that is the most recessed part of the upper surface recess 66, even when user drops down the toner cartridge 26 by mistake, the ventilation sheet 71 is less likely to collide with peripheral members to be damaged.

Figure 19:
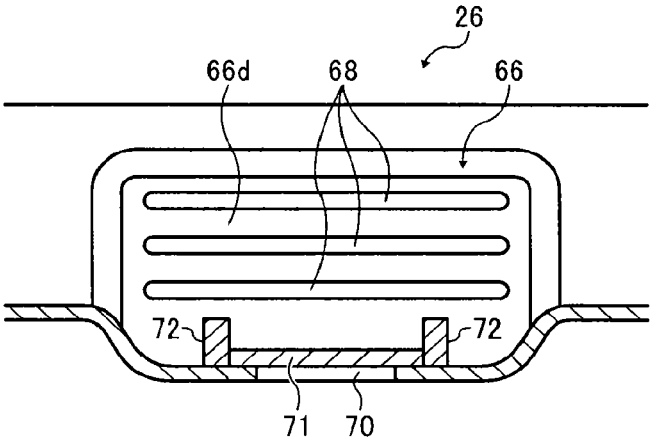
FIG. 19 is a magnified cross-sectional view of a selected part of a toner cartridge according to another embodiment of the present invention.

It is also possible to provide a projection 72 to the periphery of the ventilation sheet 71, as illustrated in FIG. 19, when there is a possibility that the ventilation sheet 71 is damaged as user unexpectedly touches the ventilation sheet 71. The projection 72 is thicker than the ventilation sheet 71 in the vertical direction and projected upward from the upper surface of the ventilation sheet 71. The projection 72 prevents user from touching the ventilation sheet 71, thereby avoiding damage to the ventilation sheet 71. The projection 72 can be provided to either the whole or a part of the circumference of the ventilation sheet 71.

Figure 20:
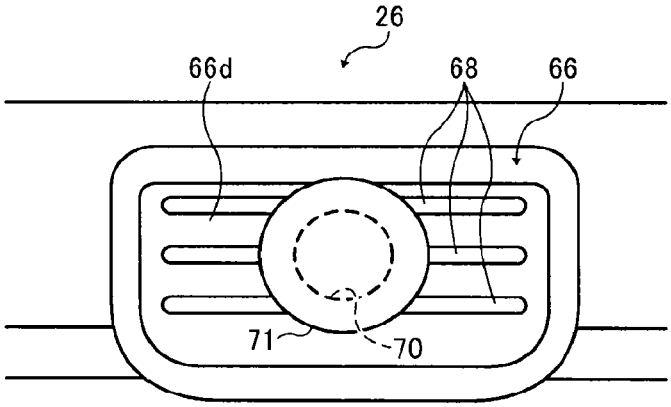
FIG. 20 is a magnified cross-sectional view of a selected part of a toner cartridge according to another embodiment of the present invention.

By contrast, when there is no possibility that the ventilation sheet 71 is damaged as user touches the ventilation sheet 71, the ventilation sheet 71 can be provided to any position which user can touch. For example, as illustrated in FIG. 20, the ventilation sheet 71 and the vent hole 70 can be provided on the back side surface 66*d* (gripper 65) of the upper surface recess 66 to be gripped by user holding the toner cartridge 26. This configuration allows user directly touching the ventilation sheet 71 with a finger. As a result, a vibration is easily transmitted to ventilation sheet 71, and toner adhered to the ventilation sheet 71 is easily taken off by the vibration. In addition, the ventilation sheet 71 may be given a color different from that of the container body 50 so as to improve visibility of the ventilation sheet 71 by user.

The vent holes and ventilations sheets having the above-described configurations (as illustrated in FIGS. 14 to 20) can be applied not only to toner cartridges but also to developing devices (development housings) other powder containers, such as waste-toner container.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A powder container, comprising:

a powder storage to store a powder to be used for image formation, the powder storage having a vent hole to pass air between an inside and an outside of the powder storage; and a conveyer to convey the powder inside the powder storage, wherein the vent hole is on an upper surface of the powder storage facing the conveyer, wherein the powder storage includes:

an upper compartment disposed on an upper part of the powder storage, a lower compartment disposed on a lower part of the powder storage, a fall port through which the powder falls down from the upper compartment to the lower compartment, and a push-up port through which the powder is pushed up from the lower compartment to the upper compartment, wherein the upper compartment has a supply opening through which the powder is externally supplied, the supply opening passing through the upper surface of the powder storage facing the conveyer, and wherein the vent hole is downstream from the supply opening relative to a direction of conveyance of the powder in the upper compartment.

2. The powder container of claim 1, wherein the conveyer includes a conveyance part having a spiral blade and an agitation part having a planar blade, and wherein the vent hole is upstream from the agitation part relative to the direction of conveyance of the powder in the upper compartment.

3. The powder container of claim 2, wherein the vent hole is upstream of the planar blade relative to the direction of conveyance of the powder in the upper compartment.

4. The powder container of claim 1, wherein the vent hole is upstream from the fall port relative to the direction of conveyance of the powder in the upper compartment.

5. The powder container of claim 1, wherein the vent hole is downstream from the push-up port relative to direction of conveyance of the powder in the upper compartment.

6. The powder container of claim 1, wherein the vent hole is above the fall port with at least a part of the vent hole overlapping with the fall port in a vertical direction.

7. The powder container of claim 1, further comprising a second vent hole above the push-up port with at least a part of the second vent hole overlapping with the push-up port in a vertical direction.

8. The powder container of claim 1, wherein the vent hole has a first length in a direction of conveyance of the powder and a second length in a direction perpendicular to the direction of conveyance of the powder, the first length being equal to or greater than the second length.

9. The powder container of claim 1, further comprising a ventilation sheet to cover the vent hole, the ventilation sheet allowing air to pass through while blocking the powder from passing through, the ventilation sheet including an oil-repellent sheet.

10. The powder container of claim 9, wherein the ventilation sheet has an air-permeable area greater than an aperture of the vent hole.

11. A developing device, comprising:

a developer container to contain a developer, the developer container being the powder container of claim 1, the developer being the powder to be used for image formation;

a developer bearer to bear the developer; and a developer supplier to supply the developer from the developer container to the developer bearer.

12. A process unit detachably mountable on an image forming apparatus, comprising:

a latent image bearer to bear a latent image; and the developing device of claim 11 to develop the latent image on the latent image bearer with the developer.

13. An image forming apparatus, comprising:

a latent image bearer to bear a latent image; and a developing device to develop the latent image on the latent image bearer with a developer, the developing device including:

a developer container to contain the developer, the developer container being the powder container of claim 1, the developer being the powder to be used for image formation;

a developer bearer to bear the developer; and a developer supplier to supply the developer from the developer container to the developer bearer.

14. A powder container, comprising:

a powder storage to store a powder to be used for image formation, the powder storage having a vent hole to pass air between an inside and an outside of the powder storage; and a conveyer to convey the powder inside the powder storage, wherein the vent hole is on an upper surface of the powder storage facing the conveyer, wherein the powder storage includes:

an upper case disposed on an upper part of the powder storage, the upper case having a recess on an upper surface thereof, the upper surface being angled and a bottom of the recess being flat, and a lower case disposed on a lower part of the powder storage, and wherein the vent hole is on the recess.

15. The powder container of claim 14, wherein the recess includes:

a bottom surface, and a back surface, and wherein the vent hole is on the bottom surface.

16. The powder container of claim 15, wherein the back surface has a plurality of ribs disposed substantially parallel to a longitudinal direction of the conveyer.

17. The powder container of claim 15, wherein the back surface of the recess extends vertically from the bottom surface of the recess.

18. The powder container of claim 14, further comprising a ventilation sheet to cover the vent hole, the ventilation sheet allowing air to pass through while blocking the powder from passing through, the ventilation sheet including an oil-repellent sheet, the ventilation sheet having an air-permeable area greater than an aperture of the vent hole.

19. The powder container of claim 18, further comprising a projection at a periphery of the ventilation sheet, the projection has a height greater than a thickness of the ventilation sheet to project upward from an upper surface of the ventilation sheet.

20. The powder container of claim 18, wherein the ventilation sheet has a color different from that of the powder storage.

* * * * *